US007823348B1

(12) United States Patent
Leiva

(10) Patent No.: US 7,823,348 B1
(45) Date of Patent: Nov. 2, 2010

(54) DEVICE AND METHOD FOR THE SUPPORT OF BOTH STEEL AND PRECAST CONCRETE WALL POSTS FOR INSTALLATION

(76) Inventor: Manuel Leiva, 3052 Burtonsville Ct., Burtonsville, MD (US) 20866

( * ) Notice: Subject to any disclaimer, the term of this patent is extended or adjusted under 35 U.S.C. 154(b) by 518 days.

(21) Appl. No.: 11/902,208

(22) Filed: Sep. 20, 2007

(51) Int. Cl.
*E02D 27/42* (2006.01)
*E04G 23/04* (2006.01)

(52) U.S. Cl. ..... 52/297; 52/170; 52/741.14; 52/745.17

(58) Field of Classification Search ..... 52/127.2, 52/152, 165, 169.9, 170, 296, 741.14, 741.15, 52/745.17, 745.18, 297, 169.13; 248/511, 248/539, 679; 33/533, 535, 404, 573
See application file for complete search history.

(56) References Cited

U.S. PATENT DOCUMENTS

| | | | | | |
|---|---|---|---|---|---|
| 976,714 | A | * | 11/1910 | Williams | 256/64 |
| 1,031,049 | A | * | 7/1912 | Conzelman | 269/114 |
| 1,679,297 | A | * | 7/1928 | Ehrler | 52/165 |
| 1,722,352 | A | | 7/1929 | Rawley | |
| 3,101,184 | A | * | 8/1963 | Allen et al. | 248/220.1 |
| 3,219,308 | A | * | 11/1965 | Halstead | 249/205 |
| 3,342,444 | A | | 9/1967 | Nelson | |
| 3,514,911 | A | | 6/1970 | Preradovich | |
| 3,617,047 | A | * | 11/1971 | Holt et al. | 269/121 |
| 3,809,346 | A | | 5/1974 | Jackson | |
| 4,216,932 | A | | 8/1980 | Silbernagel | |
| 4,311,300 | A | | 1/1982 | Buerger | |
| 5,133,164 | A | | 7/1992 | Legler | |
| 5,192,055 | A | | 3/1993 | Griggs et al. | |
| 5,218,805 | A | | 6/1993 | Rex | |
| 5,317,844 | A | | 6/1994 | Legler | |
| 5,431,372 | A | | 7/1995 | Kostelecky | |
| 5,435,097 | A | | 7/1995 | Harper | |
| 5,782,043 | A | * | 7/1998 | Duncan et al. | 52/167.1 |
| 6,240,689 | B1 | | 6/2001 | Haddad et al. | |
| 6,684,580 | B1 | | 2/2004 | Hull | |
| 6,702,239 | B2 | | 3/2004 | Boucher | |
| 2004/0131428 | A1 | * | 7/2004 | Henderson | 405/233 |
| 2006/0278800 | A1 | * | 12/2006 | Simmons | 248/511 |

* cited by examiner

*Primary Examiner*—Robert J Canfield
*Assistant Examiner*—Christine T Cajilig

(57) ABSTRACT

A system and method which positions and orients a wall post or column during positioning and supports the post after it has been positioned. The system embodying the principles of the present invention is set and contacts surfaces of the post. The system includes two monolithic one-piece anchor blocks located on a level surface to have top faces thereof located co-level with each other and tie and cross rods each of which has a surface that is vertically oriented when in use and which abuttingly engages a corresponding surface of the post when in use. At least one tie rod is connected to the anchor block top faces and the cross rod is attached to the tie rod. The tie rod is located at a desired position relative to a reference plane and the cross rod is located at a desired location relative to a reference location. The post is located between the two anchor blocks and in abutting contact with the vertically oriented surfaces of the rods. A second tie rod can be mounted on the anchor blocks prior to the connection of the first cross rod to the tie rods. The system automatically locates the post in a desired location and automatically levels the column or post so no additional adjustments are required. The system weight, including the weight of the anchor blocks, prevents shifting or movement of the post during set up.

16 Claims, 7 Drawing Sheets

DEVICE AND METHOD FOR THE SUPPORT OF BOTH STEEL AND PRECAST CONCRETE WALL POSTS FOR INSTALLATION

TECHNICAL FIELD OF THE INVENTION

The present invention relates to the general art of static structures, and to the particular field of erecting columns or posts.

BACKGROUND OF THE INVENTION

Posts and columns are used in many situation, including supporting structures, supporting signs and fences as well as many other uses. If a post or column is used to support a massive structure, that post or column must, itself, be firmly and securely anchored and supported. It is noted that the terms "post" and "column" will be used interchangeably in this disclosure.

If a post or column is used to support a massive structure, such as a soundwall, the current method of erecting that post or column is shown in FIG. 1 and proceeds as follows: a hole H is drilled in the earth E for post embedment; a post P is then raised by a crane or other mechanical means and is set in the drilled earth; concrete is poured into the hole around the post; and if necessary, rebar is placed around the post for increased support. Once the post is set in place, metal rods R are strapped along the edges of the wall post. The rods are then, anchored into the ground and straps S are firmly fastened to stabilize the wall post. The mechanism hosting the post is then detached and moved for use elsewhere. The device alone is left to support the wall post and each anchor rod is continuously fastened and adjusted to ensure that the post is properly balanced.

Proper placement and proper orientation of a post used to support panels of a soundwall are very difficult and time consuming using presently available processes and systems. First, adjacent posts must be accurately positioned relative to each other, otherwise, panels may be too loosely supported or too tightly supported. Proper placement of one large post relative to a previously-placed post is very difficult and time consuming using present systems and procedures. Second, leveling and balancing of the post is a tedious task because it requires fastening each strap little by little until the post is level on the top and along the sides. The fastening of a single anchor rod strap more than likely causes imbalance on one or more of the other sides. This is a time consuming process in which a worker spends a large portion of time and effort attempting to level and balance the post. Thus, the current systems and methods for installing posts, such as would be used in a soundwall, after embedment are inefficient and tedious.

Therefore, there is a need for a system and method for reducing the amount of time and effort spent on the step of accurately locating a post and on the step of supporting and stabilizing the post while the concrete around the post cures. By reducing the amount of time and effort spent on these steps, the overall process of erecting a post will be considerably faster and more efficient than processes using the prior art. Efficient use of time, such as crane time, will enable the posts to be ready to install as soon as they arrive so no time is wasted.

SUMMARY OF THE INVENTION

The above-discussed disadvantages of the prior art are overcome by a support system for a large column, such as would be used as a support element such as panels of a soundwall, which permits efficient and accurate location of a column relative to a reference location, and/or relative to a reference plane, and which also allows efficient orientation and support of the column in a vertical orientation due to the relative orientation of the elements of the support system. Once the support system is in place and supporting the column, it is likely that no further adjustments of the support system or column will be required to hold the column upright in the desired location. If any further adjustments are required, such adjustments will be minimal and efficient.

Using the system and method embodying the present invention will save time on the use of equipment and labor by reducing the amount of time spent locating, erecting and stabilizing a column, such as a wall post for a soundwall or the like. Current methods and systems for erecting wall posts are time consuming and onerous and accurate placement of a post may be difficult and time consuming. Furthermore, holding wall posts in place while a concrete caisson around them cures is a time consuming process during which a large portion of times and effort is expended attempting to level and balance the post. By reducing the amount of time and effort spent on the steps of accurately locating a post and then erecting the post into a vertical orientation, the process of erecting a post, and hence erecting a paneled structure such as a soundwall, will be made much more efficient and cost effective.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
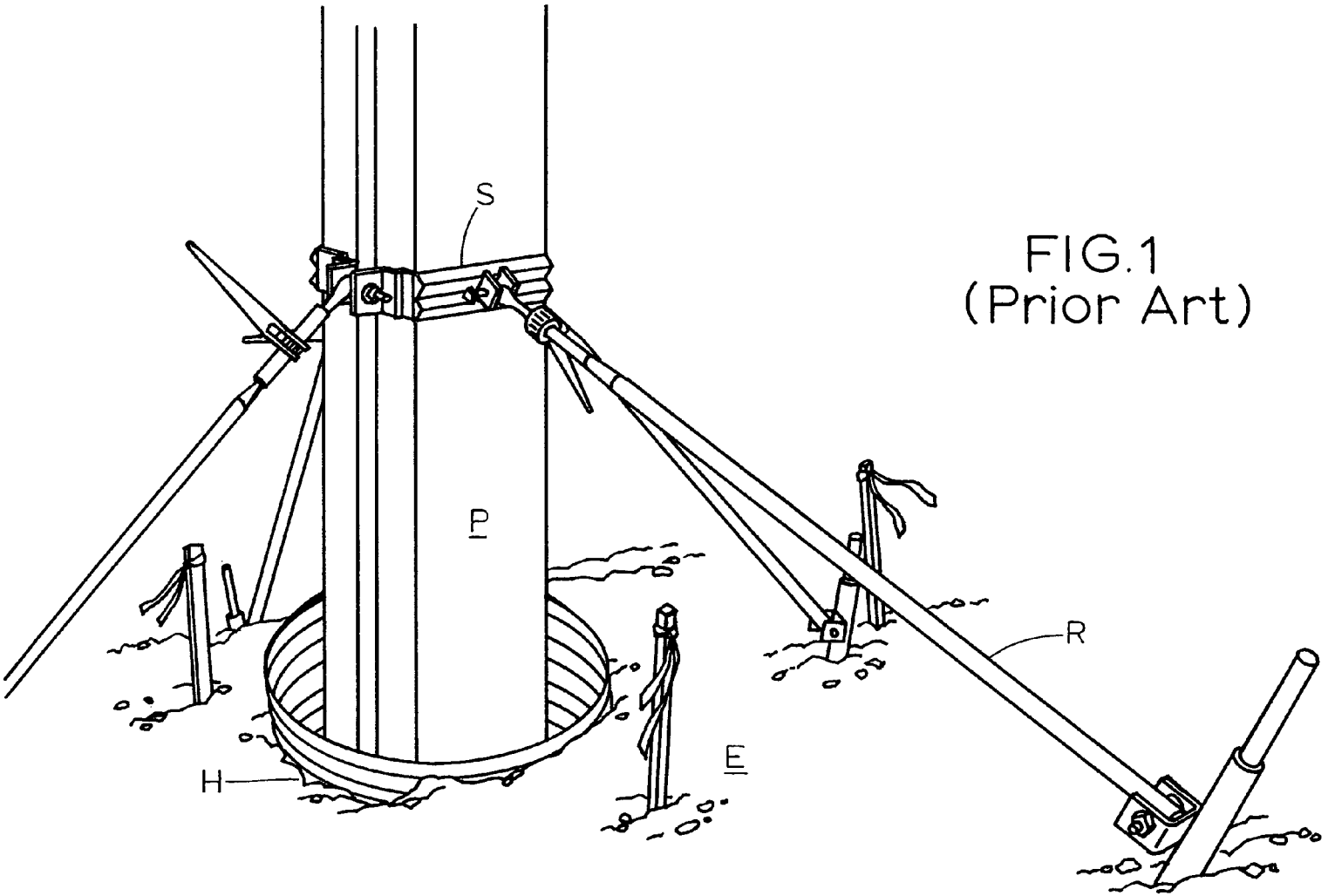
FIG. 1 (Prior Art)
FIG. 1 is a perspective view of a prior art system for supporting a post or column during installation thereof.
Figure 2:
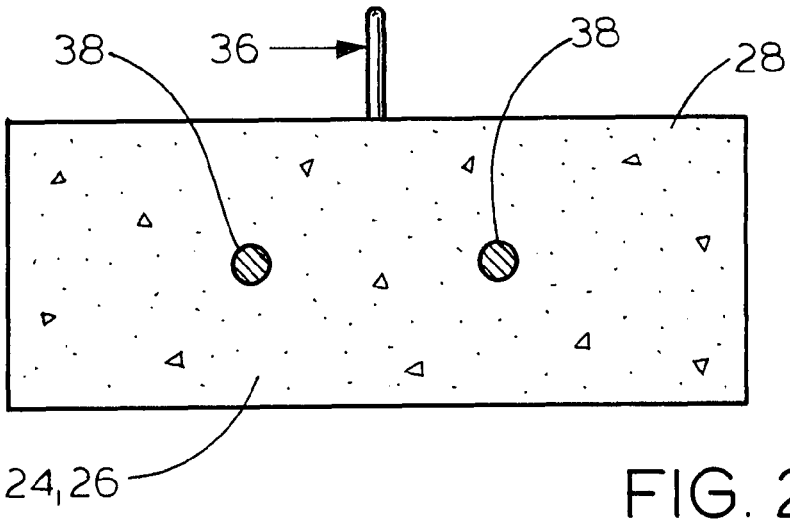
FIG. 2 is a side elevational view of an anchor block used in the system embodying the principles of the present invention.
Figure 3:
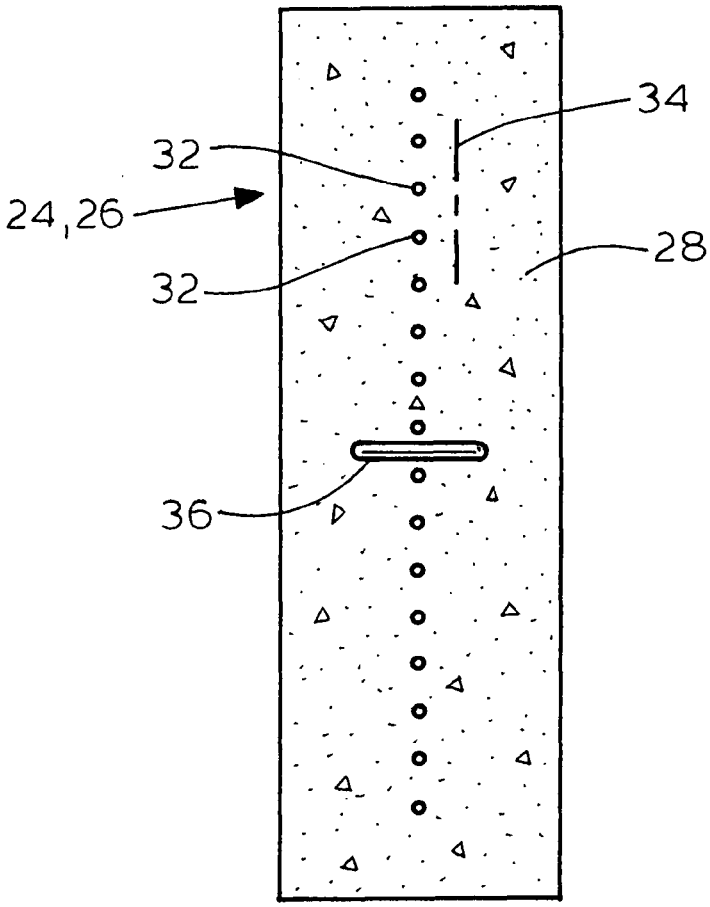
FIG. 3 is a top plan view of the anchor block.

Referring to FIGS. 2-8, it can be understood that the principles of the present invention are embodied in a support system 10 for a column 12 which supports a structure, such as a soundwall SW (see FIGS. 7 and 8) or the like. As can be understood from FIGS. 4, 5 and 6, column 12 has surfaces $12S_1$, $12S_2$, $12S_3$ and $12S_4$ which are upright during erection of the column and which are oriented vertically when the column is in use.

System 10 comprises a level surface 20, such as a leveled portion of the ground or the like. Two concrete anchor blocks 24 and 26 are located on the level surface. Each anchor block has a top face 28 which is co-level with the top face of the other anchor block. The anchor blocks are spaced apart from each other and define a gap 30 therebetween. Each anchor block includes a plurality of anchor holes 32 which are spaced apart from each other along a longitudinal axis 34 of the anchor block. A lifting hook 36 is located on top surface 28 of each anchor block and each block further includes two spaced apart handling holes 38. Anchor blocks 24 and 26 are formed of concrete and are monolithic and one-piece so they will be massive enough to, in combination with the rest of the system described herein, securely support and stabilize column 12 in a manner which permits the column to be automatically oriented in a vertical orientation with respect to level surface 20 without further substantial adjustments as will be understood from the teaching of this disclosure. The monolithic nature of the anchor blocks makes them efficient to store, transport, set up and use thereby making efficient and expeditious use of time and equipment.

System 10 further comprises tube steel, which are often referred to as square tube steel. These elements have a portion thereof that is U-shaped and will be used as tie rods and cross rods as will be understood from the teaching of this disclosure. For convenience, the elements will be referred to as being U-shaped. As can be understood from the figures, system 10 comprises two identical U-shaped tie rods 40 are securely mounted on the top faces of the anchor blocks and span gap 30 between the two anchor blocks when the tie rods are in use as shown in FIGS. 4-8. Each tie rod has two equal length legs 42 and 44 and a bight section 46 which connects legs 42 and 44 together. Each of the legs 42 and 44 has a rim 48 spaced apart from the bight section, and the rim of each of the legs of each tie rod is abuttingly supported on top faces 28 of the anchor blocks when the tie rods are in use. The legs of the tie rods are oriented to be vertical with respect to the level surface whereby all of the legs of the tie rods are parallel to each other when the tie rods are in use.

The bight section of each tie rod has a plurality of locking pin accommodating holes 50 defined therethrough and which are spaced apart from each other in the direction of longitudinal axis 52 of each tie rod. The spaced apart holes are used to accurately and efficiently locate a post with respect to an adjacent post as will be understood from the teaching of this disclosure.

System10 further includes two identical U-shaped cross rods 60 attached to the tie rods when the cross rod is in use. Each of the cross rods has two equal length legs 62 and 64 and a bight section 66 to which legs 62 and 64 of the cross rod are attached. Each of the legs of the cross rod has a rim 68 that is spaced apart from the bight section of the cross rod and which are abuttingly supported on bight sections 46 of the tie rods when the cross rod and the tie rods are in use. The legs of the cross rods are oriented to be vertical with respect to the level surface when the cross rods are in use. The bight section of each cross rod has a plurality of locking pin accommodating holes 70 defined therethrough and which are spaced apart from each other in the direction of longitudinal axis 72 of each cross rod.

Figure 4:
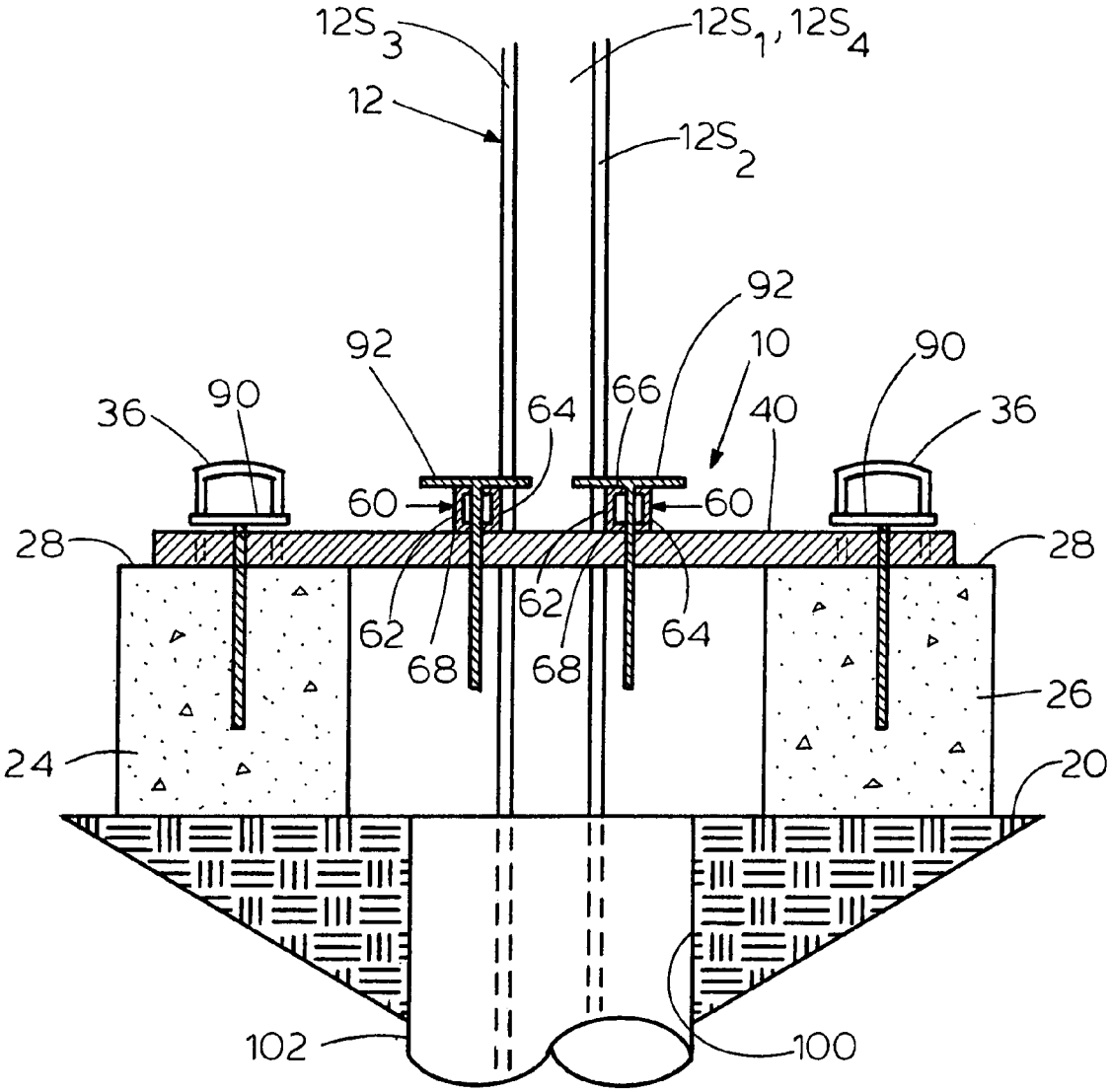
FIG. 4 is a side elevational schematic view of the system embodying the principles of the present invention.
Figure 5:
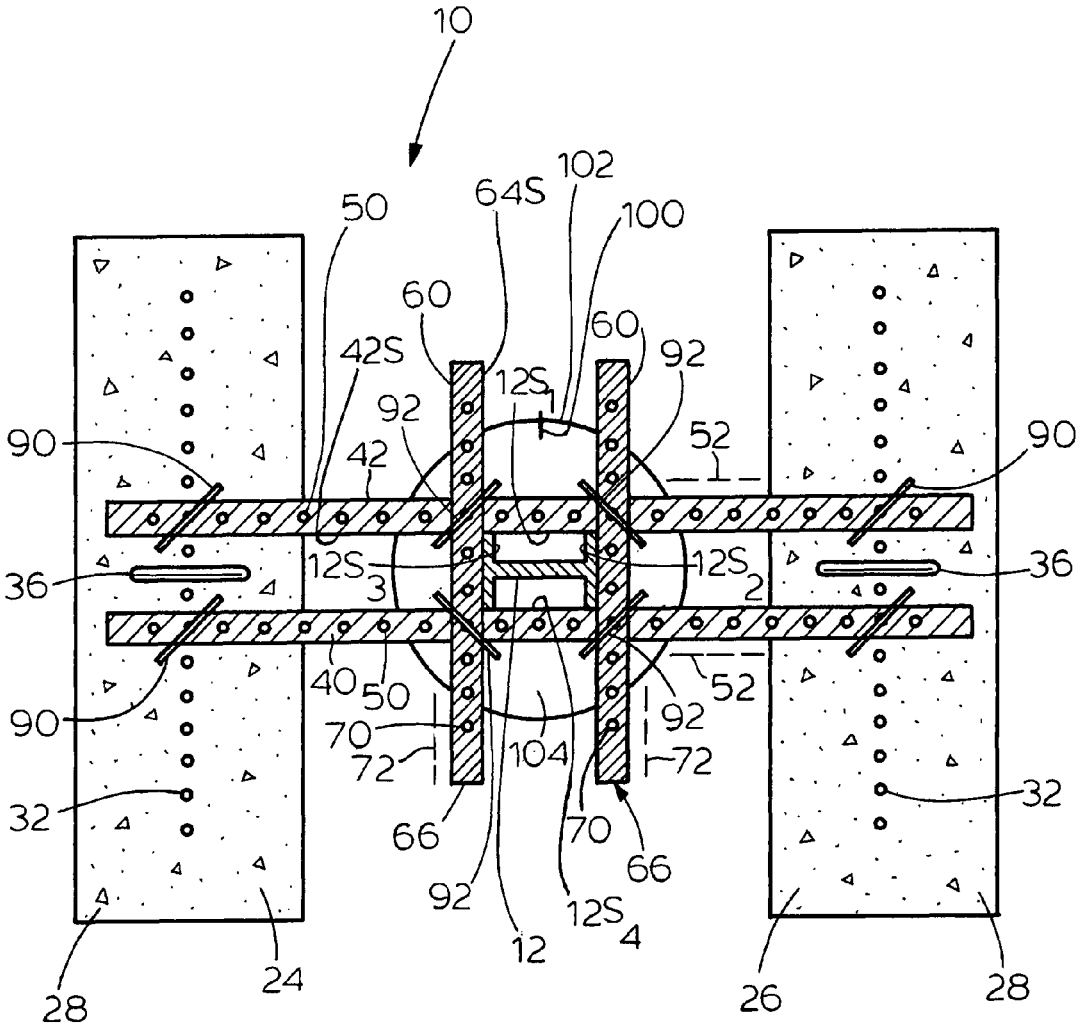
FIG. 5 is a schematic of a top plan view of the system embodying the principles of the present invention in use.
Figure 6:
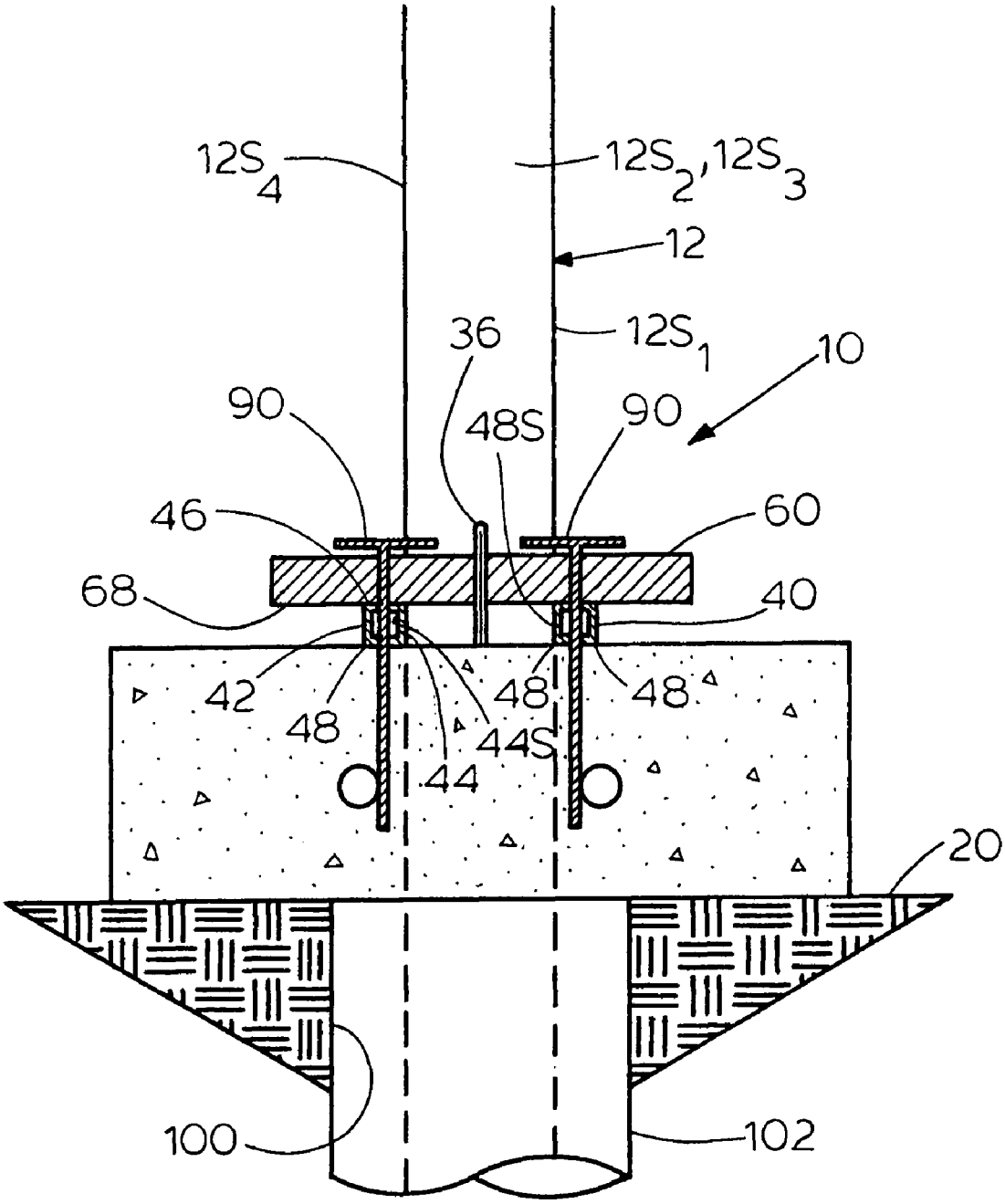
FIG. 6 is a schematic of an end elevational view of the system embodying the principles of the present invention in use.
Figure 7:
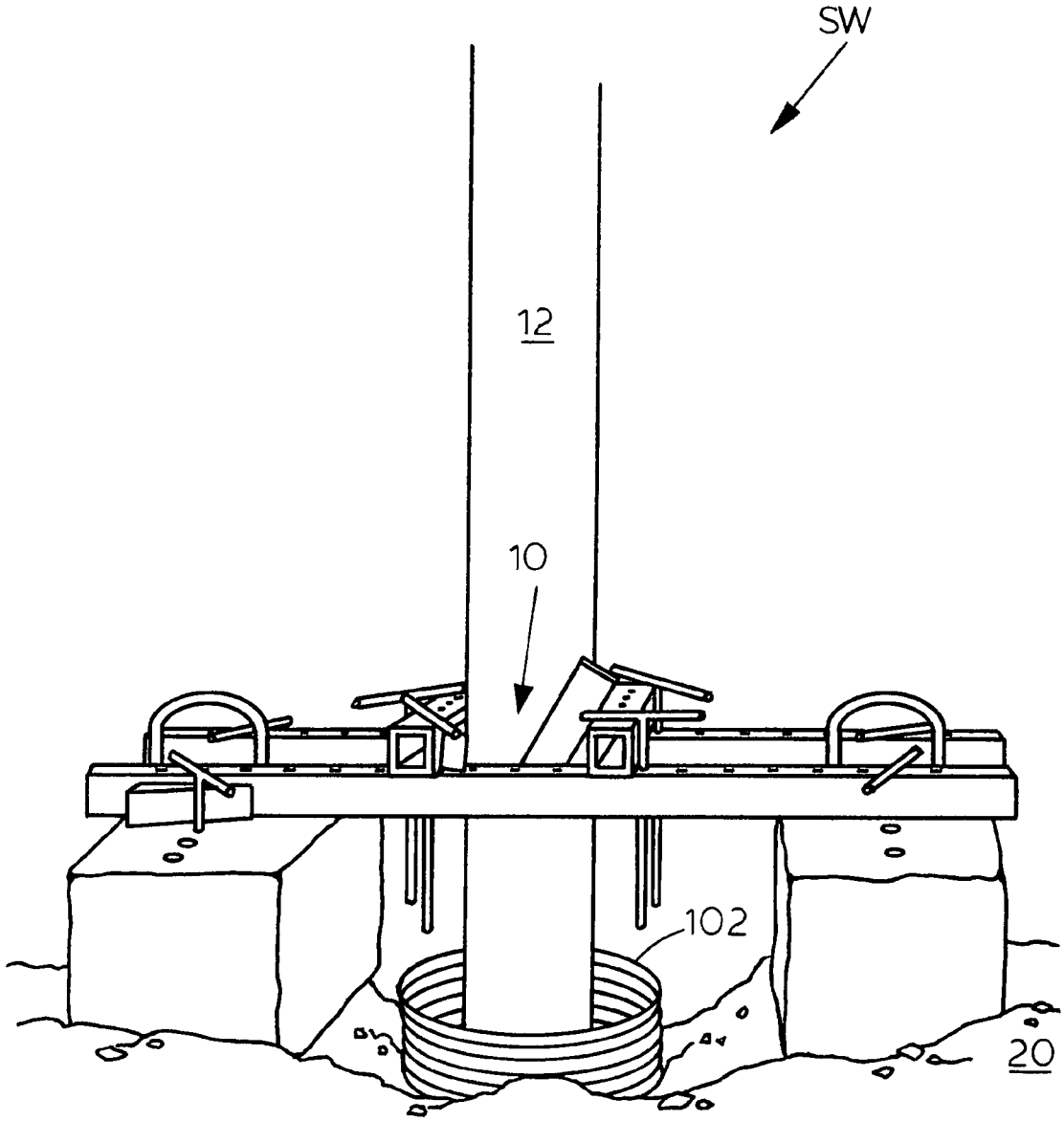
FIG. 7 shows the system embodying the principles of the present invention in use supporting a column.
Figure 8:
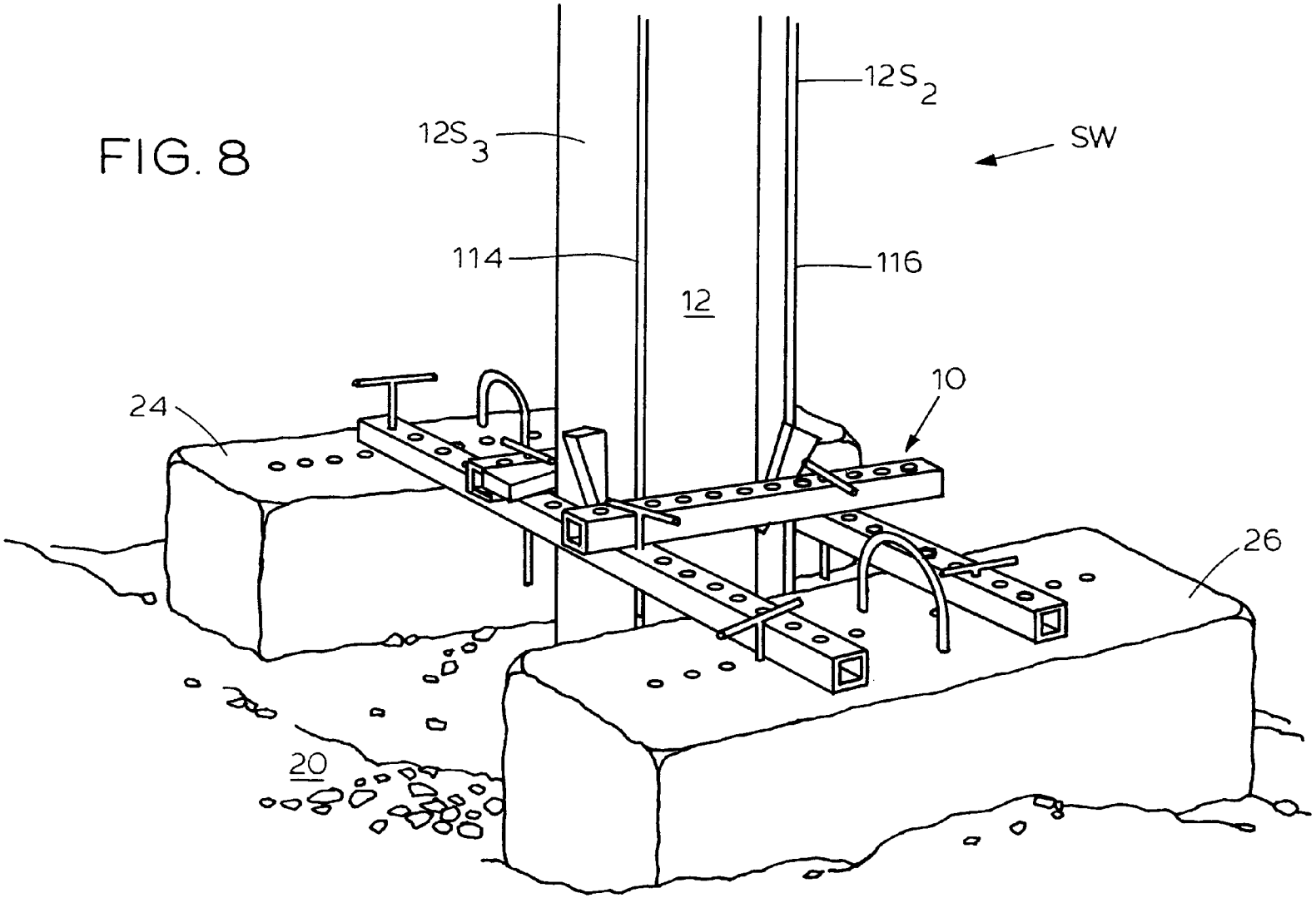
FIG. 8 shows the system embodying the principles of the present invention in use supporting a column that is used in a soundwall.

As can be understood from FIGS. 4, 5 and 6, each rod further includes a surface, such as surface 42S for tie rod 40 and surface 64S for cross rod 60, which will abut an upright surface of a column. Surfaces 42S and 64S are planar and are oriented vertically by the geometric arrangement of system 10. Abutment of the vertically oriented surfaces 42S and 64S with the upright column surfaces $12S_1$ and $12S_2$ respectively will automatically orient column 12 vertically as well as positionally. As will be understood from this disclosure, surface 42S is positioned so the column will support a panel to be co-planar with adjacent panels, and surface 64S is located to position the column in a desired location with respect to a reference location, such as an adjacent column, whereby the columns are spaced apart a distance that is proper for secure and proper support of the panels such that the panels are not too loosely held or too tightly held. The position and orientation of the column are thus set automatically by system 10.

A locking pin 90 is accommodated through the locking pin accommodating holes in the bight section of each tie rod and is abuttingly engaged in one of the anchor holes 32 defined in an associated one of the anchor blocks when in use. A second locking pin 92 is accommodated through one of the locking pin accommodating holes 70 defined in one of the cross rods and in an associated one of locking pin accommodating holes 50 defined in one of the tie rods when in use.

A column accommodating hole 100 is defined through the level surface and a sleeve 102 can be located in the hole 100 if required by soil conditions. Cement 104 is located in the column accommodating hole adjacent to the column accommodated in the column accommodating hole to support the post when the post is in use.

Once hole 100 is defined, measurements are made using a reference location, such as a previously placed post or column, as a starting point. The measurements include one measurement to locate the new post in position to hold a panel between the previously-placed post or support and the post being placed in position to be co-planar with adjacent panels, such as a panel supported between a previously-placed post and the post placed previous to that post whereby a planar vertical surface is defined by the panels supported by the posts. The first measurement is used to locate the first tie rod with respect to the longitudinal axis of the block whereby surface 42S is located to abut a corresponding surface of the column to position the column to effect the co-planar orientation of a panel supported by the column with respect to a reference position, such as co-planar with adjacent panels. As can be seen in the figures, the longitudinal axis of each block is oriented transverse to a panel, that is, from front to back surface of the panel. This will orient a panel to be co-planar with an adjacent panel. Once the first tie rod is located to maintain the to-be erected panel co-planar with a reference position or reference plane, such as a plane which contains adjacent panels of the wall, the first tie rod can be mounted on, or connected to, the blocks.

The thickness of the post is determined, and once the first tie rod is in place, a measurement is made transverse to the mounted tie rod that is equal to the thickness of the post to be supported. Once this thickness measurement is made, the second tie rod is mounted on the anchor blocks at a distance that will accommodate the post between the two mounted tie rods in a secure and stable manner.

A third measurement will then be made on one of the mounted tie rods to properly locate the to-be erected post or column with respect to a reference location, such as a base location, a previously-erected post or the like, that will be adjacent thereto. Any suitable distance indicia, such as center-to-center distances or the like, can be used to locate the to-be erected post with respect to the reference location whereby a panel supported by adjacent posts or columns, which include the to-be erected post will be properly held by the two posts. The proper location of a portion of the to-be erected post is noted on at least one of the mounted tie rods. A cross rod is connected to the mounted tie rods adjacent to the marked position on the tie rods so that surface 64S of the cross rod is located at the desired position with respect to the reference location whereby the area between the connected tie rods and the cross rod connected thereto will properly locate a post positioned in that area and abutment between surfaces 64S and 12$S_3$ will locate the column or post properly with respect to the reference location. Furthermore, the post will be securely positioned due to the three rods abutting the post.

A post or column can then be placed in the hole 100 adjacent to the noted location on the tie rods and in abutting contact with the tie rods and the cross rod connected to the mounted tie rods. The post will be properly located by the three rods. Thus, the post will be properly located with respect to the reference position with a minimum effort. Furthermore, the vertical orientation of the surfaces of the tie and cross rods will automatically orient the post or column in the desired vertical orientation. A second cross rod can then be placed on the mounted tie rods with the post being interposed between the two tie rods and between the two cross rods. If necessary, shims, such as oak wood wedges, can be inserted between the rods and the post. The spaced apart holes on the rods allows proper and secure connection and mounting of the rods.

Column 12 is located between the anchor blocks and between the tie rods and the cross rods. In the form shown, column 12 is an I-beam, but could be any other suitable form without departing from the scope of this disclosure. As discussed above, the column or post has four surfaces 12$S_1$-12$S_4$ that are oriented vertically with respect to the level surface when the column is set up. Each of the surfaces of the column is abuttingly engaged by a corresponding leg of the tie rods and the cross rods when the cross rods and tie rods are in use. The vertical legs of the tie rods and the cross rods are all parallel with respect to each other and are all vertically oriented due to the geometric arrangement of system 10 so the abutment between the legs of the rods and the surfaces of the column causes the column to be automatically supported in a vertical orientation by the rods. The vertical orientation of the column is automatic and does not require any further adjustments. Accordingly, set up of the column is expeditious and makes efficient use of time and equipment.

The use of system 10 embodying the principles of the present invention to erect a post that will be used to support a panel of a panel wall, such as sound wall is as follows. Prior to use of the system, a hole is drilled in the earth for post embedment. The hole is located adjacent to a reference location such as a previously-erected post or a starting location. The ground adjacent to the hole is leveled. The two concrete anchor blocks are then placed on opposite sides of the hole and have top surfaces that are essentially co-planar with each other and with the level surface. A first tie rod is positioned on the top surfaces of the anchor blocks to extend past the hole. The first tie rod is moved with respect to the hole so it has one face, such as surface 42S, located adjacent to a plane that is essentially co-planar with either an adjacent panel of the wall or in a plane of a first panel of the wall. The first tie rod is then connected to the two anchor blocks. A first measurement is then made to determine spacing between two tie rods. The second measurement corresponds to the thickness of the to-be erected post. A third measurement is then made on the tie rods to determine the exact location of the to-be erected post with relation to a reference location, such as the previously-erected post or the starting location, and a cross rod is attached to the two mounted tie rods at a location so one surface, such as surface 64S, of the first cross rod is located immediately adjacent to the exact location on the first tie rod. The first cross rod is oriented to extend transverse to the mounted tie rods. A post is then hoisted into position superadjacent to the hole and the tie and cross rods of system 10 and is lowered into the hole with one upright surface of the post, such as surface 12$S_1$, in contact with surface 42S of the first tie rod and a second upright surface of the post, such as surface 12$S_3$ in contact with surface 64S of the first cross rod. A third surface of the post, such as surface 12$S_4$, is in abutting contact with the second tie rod. The post will be located in the exact position desired due to the positioning of the tie rods and the first cross rod on the tie rods, and the post will be oriented vertically due to the vertical orientation of the post-contacting surfaces of the tie and cross rods and the level orientation of the top surfaces of the anchor blocks. Because both blocks are set on a flat, level surface they should have the top faces thereof at or near the same elevation and will provide balance and equal distribution of support (see FIG. 4). After the post is located in the hole, a second cross rod is then connected to the two tie rods and engages another vertical surface of the post, such as surface 12$S_2$, with the post being located between the two cross rods. The second tie rod and the second cross rod also have surfaces that are oriented vertically due to the geometry of the system and further support the post in a vertical orientation due to the contact between the vertical surfaces of the second tie and cross rods and the corresponding surfaces of the post. Two of the rods are parallel to the anchor blocks and two are perpendicular (see FIG. 5). The system is set up so that surfaces of the column or post will abuttingly engage the vertically oriented surfaces of the rods. Once the rods are properly set against the edges of the wall post, the steel locking pins are inserted through the holes defined in the rods and the holes defined in the anchor blocks (see FIG. 4). There should be no gaps or spaces between the rods and the edges of the post; however, if there are, shims, such as wood wedges, can be inserted between the rods and the post to ensure a tight, secure fit between the rods and the post. Vertical orientation of the post is effected by the first tie rod and the first cross rod, and is ensured by the second tie and cross rods. Because the anchor blocks are set on a level surface to begin with, the system holding the wall post will be level and balanced and will automatically orient the surfaces of the post to be vertical thus eliminating the need for adjustments. Furthermore, exact measurements can be carried out on one of the tie rods so the post will be placed in the exact desired location on the first try rather than by trial and error. Once the system is set, the crane or other mechanical device can be removed from the post. If there is empty space between the earth and the post, this empty space can be filled with concrete creating a caisson, which will serve as the long term support for the post. After the concrete caisson has cured, the system can be removed and used elsewhere.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A support system for a column comprising:

a level surface;

two anchor blocks located on the level surface, each anchor block having a top face which is co-level with the top face of the other anchor block, the anchor blocks being spaced apart from each other and defining a gap therebetween;

at least one tie rod securely mounted on the top faces of the anchor blocks and spanning the gap between the two anchor blocks when the tie rod is in use, the tie rod having two equal length legs and a bight section connecting the legs together, each leg having a rim spaced apart from the bight section of the tie rod, the rims of the legs of the tie rod being abuttingly supported on the top faces of the anchor blocks when the tie rod is in use, the legs of the tie rod being oriented to be vertical with respect to the level surface whereby all of the legs of the tie rod are parallel to each other, the tie rod having a first surface of one leg located in a plane that is positioned adjacent to a predetermined location with respect to a reference plane;

at least one cross rod attached to the tie rods when the cross rod is in use, the cross rod having two equal length legs and a bight section to which the legs of the cross rod are attached, each of the legs of the cross rod having a rim that is spaced apart from the bight section of the cross rod and which are abuttingly supported on the bight sections of the tie rod when the cross rod and the tie rod are in use and which are oriented to be vertical with respect to the level surface, the cross rod having a first surface that is located at a predetermined position relative to a reference location;

a column located between the anchor blocks and between the tie rod and adjacent to the cross rod, the column having surfaces that are oriented vertically with respect to the level surface when the column is set up, with one surface of the column being abuttingly engaged by the first surface of the tie rod and a second surface of the column being abuttingly engaged by the first surface of the cross rod when the cross rod and tie rod are in use;

the vertical legs the tie rod and the cross rod all being parallel with respect to each other and all being vertically oriented so the abutment between the first surfaces of the tie and cross rods and corresponding surfaces of the column causes the column to be automatically supported in a vertical orientation by the rods and automatically positioned in a desired position with respect to the reference location and the reference plane.

2. The support system defined in claim 1 further including a second cross rod which is located to abuttingly engage a surface of the column and a second tie rod which is located to abuttingly engage a surface of the column.

3. The support system defined in claim 1 further including a plurality of anchor holes defined in each anchor block, a plurality of locking pin accommodating holes defined through the bight section of the tie rod, and a locking pin accommodated through the locking pin accommodating holes in the bight section of the tie rod and abuttingly engaged in one of the anchor holes defined in an associated one of the anchor blocks.

4. The support system defined in claim 3 further including a plurality of locking pin accommodating holes defined through the bight section of the cross rod and a second locking pin accommodated through one of the locking pin accommodating holes defined in the cross rod and in an associated one of locking pin accommodating holes defined in the tie rod.

5. The support system defined in claim 1 wherein each anchor block is monolithic and one-piece.

6. The support system defined in claim 1 further including a column accommodating hole defined in the level surface and cement located in the column accommodating hole adjacent to the column accommodated in the column accommodating hole.

7. The support system defined in claim 1 further including a two panels supported on the column.

8. The support system defined in claim 1 further including a lifting hook element securely mounted on the top face of each anchor block.

9. The support system defined in claim 5 wherein each anchor block is formed of concrete.

10. A method for supporting a column during erection of that column comprising:

defining a hole in a surface;

leveling the surface adjacent to the hole;

forming two anchor blocks to each be monolithic and one-piece;

locating the two monolithic one-piece anchor blocks on the level surface with the hole located between the two anchor blocks;

orienting a top face of each anchor block to be co-level with the top face of the top face of other anchor block;

mounting a tie rod on the top faces of the anchor blocks and spanning the gap between the two anchor blocks with the tie rod, the tie rod having two equal length legs and a bight section connecting the legs together, each leg having a rim spaced apart from the bight section of the tie rod with which the leg is associated;

abuttingly supporting the rims of the legs of the tie rod on the top faces of the anchor blocks;

orienting the legs of the tie rod to be vertical with respect to the level surface and maintaining all of the legs of the tie rod parallel to each other;

locating the tie rod such that one leg of the tie rod is positioned at a desired position adjacent to a plane that is co-planar with a reference plane;

identifying a specified location on the tie rod according to a preset distance between the specified location and a reference location;

providing a cross rod, the cross rod having two equal length legs and a bight section to which the legs of the cross rod are attached, each of the legs of the cross rod having a rim that is spaced apart from the bight section of the cross rod;

attaching the cross rod to the tie rod so the cross rod has a one leg located adjacent to the specified location on the tie rod;

abuttingly supporting the rims of the legs of the cross rod on the bight sections of the tie rod and automatically orienting the legs of the cross rod to be vertical with respect to the level surface;

locating a column between the anchor blocks and adjacent to the tie rod and adjacent to the cross rod, the column having surfaces that are oriented vertically with respect to the level surface when the column is in use;

abuttingly engaging one surface of the column with the one leg of the tie rod and a second surface of the column with the one leg of the cross rod;

maintaining the vertical legs the tie rod and the cross rod parallel with respect to each other and vertically oriented;

automatically supporting the column vertically by the abutment between the one leg of the tie rod and the one leg of the cross rod and surfaces of the column without further adjustment; and automatically locating the column at the specified location with respect to the reference location and at the desired position with respect to the reference plane by the abutment between the legs of the rods and corresponding surfaces of the column without further adjustment of the column.

11. The method defined in claim 10 further including locating a second cross rod to abuttingly engage a surface of the column.

12. The method defined in claim 10 further including locating a second tie rod on the anchor blocks a distance from the first-mentioned tie rod corresponding to the thickness of the column prior to locating the first-mentioned cross rod to abuttingly engage a surface of the column and connecting the first-mentioned cross rod to the tie rods.

13. The method defined in claim 10 further including defining a plurality of anchor holes in each anchor block, defining a plurality of locking pin accommodating holes through the bight section of each tie rod, and a accommodating a locking pin through the locking pin accommodating holes in the bight section of each tie rod and abuttingly engaging the locking pin in one of the anchor holes defined in an associated one of the anchor blocks.

14. The method defined in claim 13 further including defining a plurality of locking pin accommodating holes through the bight section of the cross rod and accommodating a second locking pin through one of the locking pin accommodating holes defined in the cross rod and in an associated one of locking pin accommodating holes defined in one of the tie rods.

15. The method defined in claim 10 further including forming each anchor block of concrete.

16. The method defined in claim 10 further including defining a column accommodating hole in the level surface and locating cement in the column accommodating hole adjacent to the column accommodated in the column accommodating hole.

* * * * *